US006113114A

United States Patent [19]

Zemke et al.

[11] Patent Number: 6,113,114

[45] **Date of Patent: *Sep. 5, 2000**

[54] SNOWBOARD BINDING

[75] Inventors: Hubert R. Zemke, Carson City, Nev.; Lars L. Pak, Seattle, Wash.; Om P. Trehan, Bothell, Wash.; Wenhao Wu, Redmond, Wash.; Steven M. Cartier, Battle Ground, Wash.

[73] Assignee: Sims Sports, Inc., Bothell, Wash.

[ * ] Notice: This patent is subject to a terminal disclaimer.

[21] Appl. No.: 09/318,899

[22] Filed: May 26, 1999

Related U.S. Application Data

[63] Continuation of application No. 08/824,399, Mar. 26, 1997, Pat. No. 5,971,407.

[51] Int. Cl.[7] ..... B62B 9/04

[52] U.S. Cl. ..... 280/14.26; 280/618

[58] Field of Search ..... 280/14.2, 617, 280/618, 636; 36/115

[56] References Cited

U.S. PATENT DOCUMENTS

| | | | |
|---|---|---|---|
| 3,892,422 | 7/1975 | Jaques et al. | 280/11.35 |
| 5,261,689 | 11/1993 | Carpenter et al. . | |
| 5,480,176 | 1/1996 | Sims | 280/618 |
| 5,503,900 | 4/1996 | Fletcher | 428/160 |
| 5,505,478 | 4/1996 | Napoliello | 280/618 |
| 5,609,347 | 3/1997 | Dressel . | |
| 5,660,410 | 8/1997 | Alden | 280/627 |
| 5,669,622 | 9/1997 | Miller | 280/615 |
| 5,794,362 | 8/1998 | Polk, III et al. | 36/97 |

FOREIGN PATENT DOCUMENTS

| | | |
|---|---|---|
| 0 351 298 | 1/1990 | European Pat. Off. . |
| 9-6613 | 3/1997 | Japan . |

*Primary Examiner*—Kevin Hurley
*Assistant Examiner*—Kevin McKinley
*Attorney, Agent, or Firm*—Townsend and Townsend and Crew LLP

[57] ABSTRACT

An improved snowboard binding (6) has an adjustably positioned toe ramp (44) mounted to the front end (32) of the base (18) with an upwardly curving front portion (62) shaped to conform to the toe (14) of the boot sole (12) to increase the toe-side edge responsiveness. A dampened, energy absorbing heel pad (66) is mounted to the rear end (28) of the base to help absorb impact. Arm channels (84,86) are formed in each of the left and right side flanges (22,24), extend upwardly from the baseplate (20), and are sized to contain the left and right mounting arms (94,96) of a heel support (26). A pair of threaded fasteners (104,108) clamp the mounting arms within the side flanges over a range of upwardly and rearwardly extending portions. Front-and-rear forces on the heel support are resisted by the two fasteners and by engagement of the upper and lower edges (122,124) of the arms with upper and lower channel walls (88,89). Lateral forces exerted by the heel support on the base are effectively resisted by this channeled side flange construction.

20 Claims, 6 Drawing Sheets

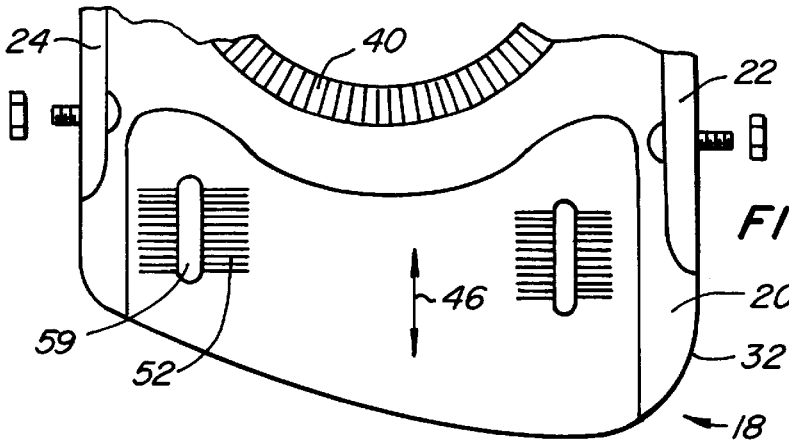
FIG. 3.
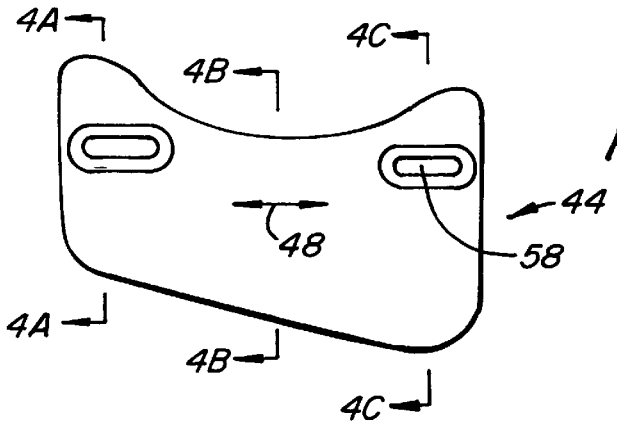
FIG. 4.
FIG. 4A.
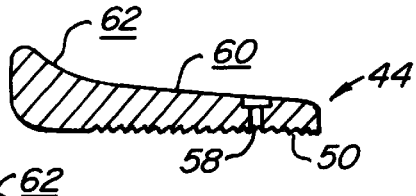
FIG. 4B.
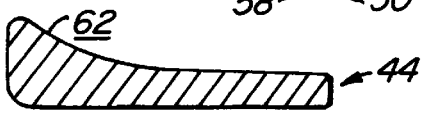
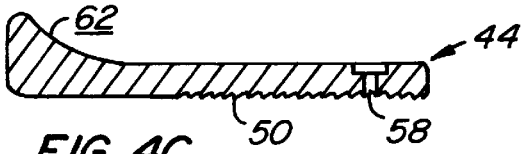
FIG. 4C.
FIG. 5.
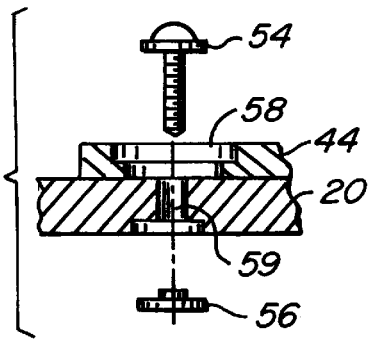

SNOWBOARD BINDING

CROSS-REFERENCE TO RELATED APPLICATIONS

This is a Continuation Application of application Ser. No. 08/824,399, filed Mar. 26, 1997, now U.S. Pat. No. 5,971, 407, issued Oct. 26, 1999, the disclosure of which is incorporated by reference.

BACKGROUND OF THE INVENTION

Snowboarding is a popular, fast-growing but relatively new sport. As snowboarders become more adept at pushing the limits of what they can do on a snowboard, manufacturers of snowboard equipment are continuously looking for ways to improve their products.

SUMMARY OF THE INVENTION

The present invention is directed to an improved snowboard binding having a toe ramp which permits enhanced transfer of load from the foot through the binding to the snowboard, a heel pad with a dampened energy absorber to cushion the impact on the user's foot and leg, and an improved connection between the heel support and the base of the binding for improved strength, rigidity and ease of assembly.

The toe ramp, mounted to the front end or toe of the base, has an upwardly extending front portion preferably shaped for complementary mating engagement with the front end of the sole of a snowboard boot. This conforming engagement helps increase the level of toe-side edge responsiveness while snowboarding by transmitting force from the foot through the binding to the board quicker than occurs with a conventional binding without such a ramp. It is preferred that the toe ramp be adjustably positioned to the base, both in forward and rearward and side-to-side directions.

The base includes a base plate and left and right side flanges extending upwardly from the base plate. Arm channels are formed in each of the left and right side flanges. The arm channels are configured and sized to circumscribe and house the left and right mounting arms of the heel support. The arm channels are each partially defined by upper and lower support surfaces, which lie adjacent to the upper and lower edges of the mounting arms, and lateral support surfaces, which lie adjacent to the lateral surfaces of the mounting arms. Mounting elements, typically a pair of threaded fasteners, are passed through holes formed in the side flanges and mounting arms so to clamp the side arms between the lateral support surfaces of the side flanges. Force on the heel support in a generally vertical plane is preferably resisted at at least four places, through the two fasteners and at the upper and lower support surfaces. In addition, lateral or side-to-side forces exerted by the heel support on the base is effectively resisted by this channeled side flange construction.

In one embodiment, the heel pad is mounted to the base at a fixed position. It can, however, be adjustably positioned on the base for front-to-rear and/or side-to-side adjustment. The heel pad can have a flat upper surface or, especially if its position is adjustable, it can have an upwardly extending heel rest portion shaped to conform to or at least contact the heel of the user's boot.

The mounting elements used to secure the mounting arms to the side flanges are preferably part of a mounting assembly. Each mounting assembly includes a coupler or body from which a pair of internally threaded tubes extend.

Screws engage the internally threaded tubes to secure the mounting assembly in place. These mounting assemblies not only speed production, they also help to provide better, more uniform clamping of the mounting arms within the side flanges. The mounting arms and side flanges are configured so the mounting arms can be secured to the side flanges over a range of mounting positions. The different mounting positions permit the heel support to be positioned at different vertical and longitudinal positions to accommodate different size boots.

Other features and advantages will appear from the following description in which the preferred embodiments have been set forth in detail in conjunction with the accompanying drawings.

BRIEF DESCRIPTION OF THE DRAWINGS

FIG. 3 is an enlarged top plan view of the front portion of the base of FIG. 2 with the toe ramp removed;

FIG. 4 is a top plan view of the toe ramp of FIG. 2;

FIGS. 4A–4C are cross-sectional views taken along lines 4A—4A, 4B—4B and 4C—4C of FIG. 4;

FIG. 5 is a cross-sectional view taken passing through the mounting slots formed in the base plate and toe ramp of FIG. 2 showing the mounting screw and nut in an exploded view;

DETAILED DESCRIPTION OF THE SPECIFIC EMBODIMENTS

Figure 1:
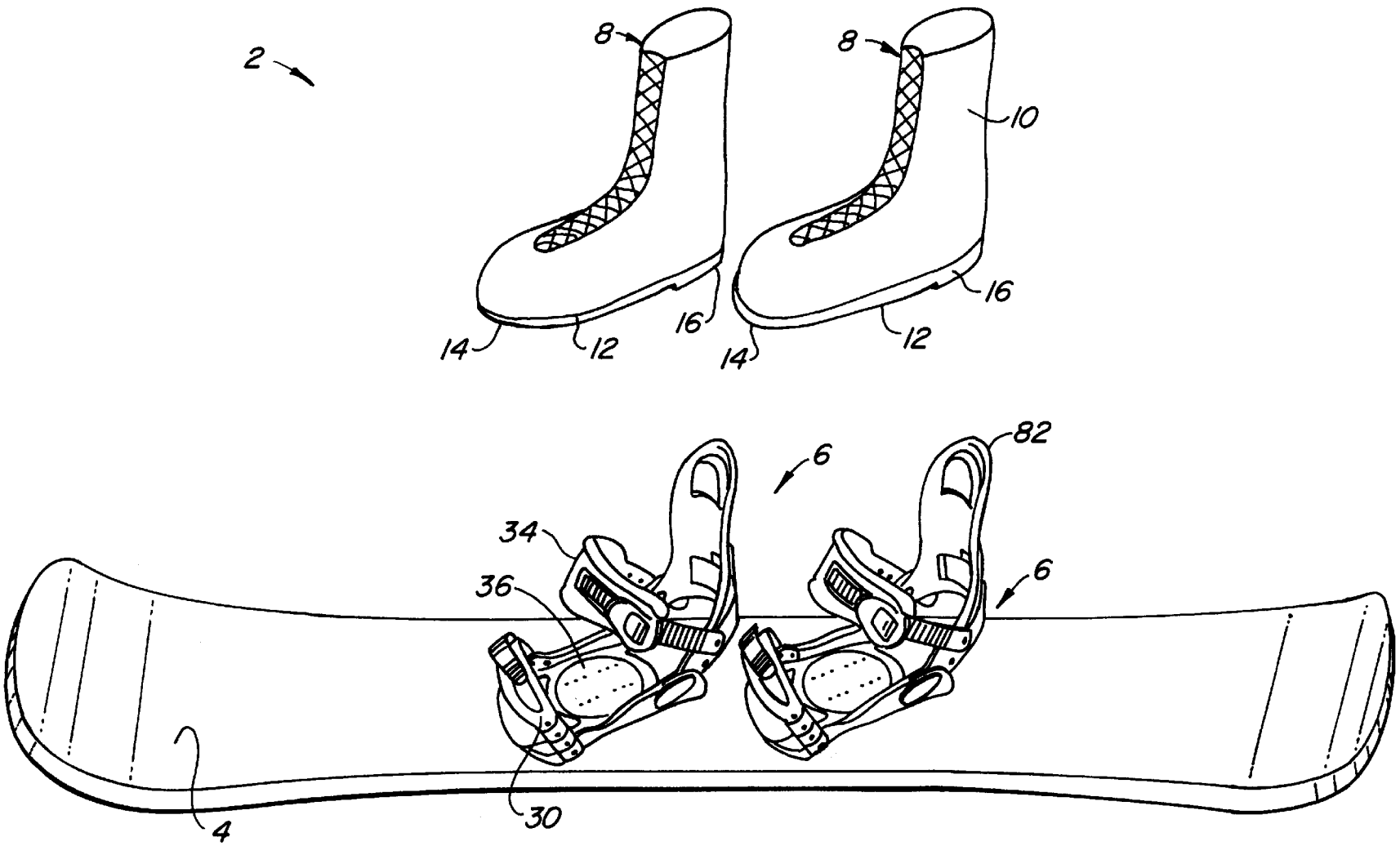
FIG. 1 is a simplified, overall view showing a snowboard assembly, including a board and a pair of snowboard bindings mounted to the snowboard, together with a pair of snowboard boots used with the snowboard bindings.

FIG. 1 illustrates a snowboard assembly 2 including a snowboard 4 and a pair of snowboard bindings 6. Also illustrated are a pair of snowboard boots 8 designed to be secured to snowboard 4 by bindings 6. Each boot includes an upper 10 and a sole 12. The sole 12 includes a toe or front end 14 and a heel 16.

Figure 2:
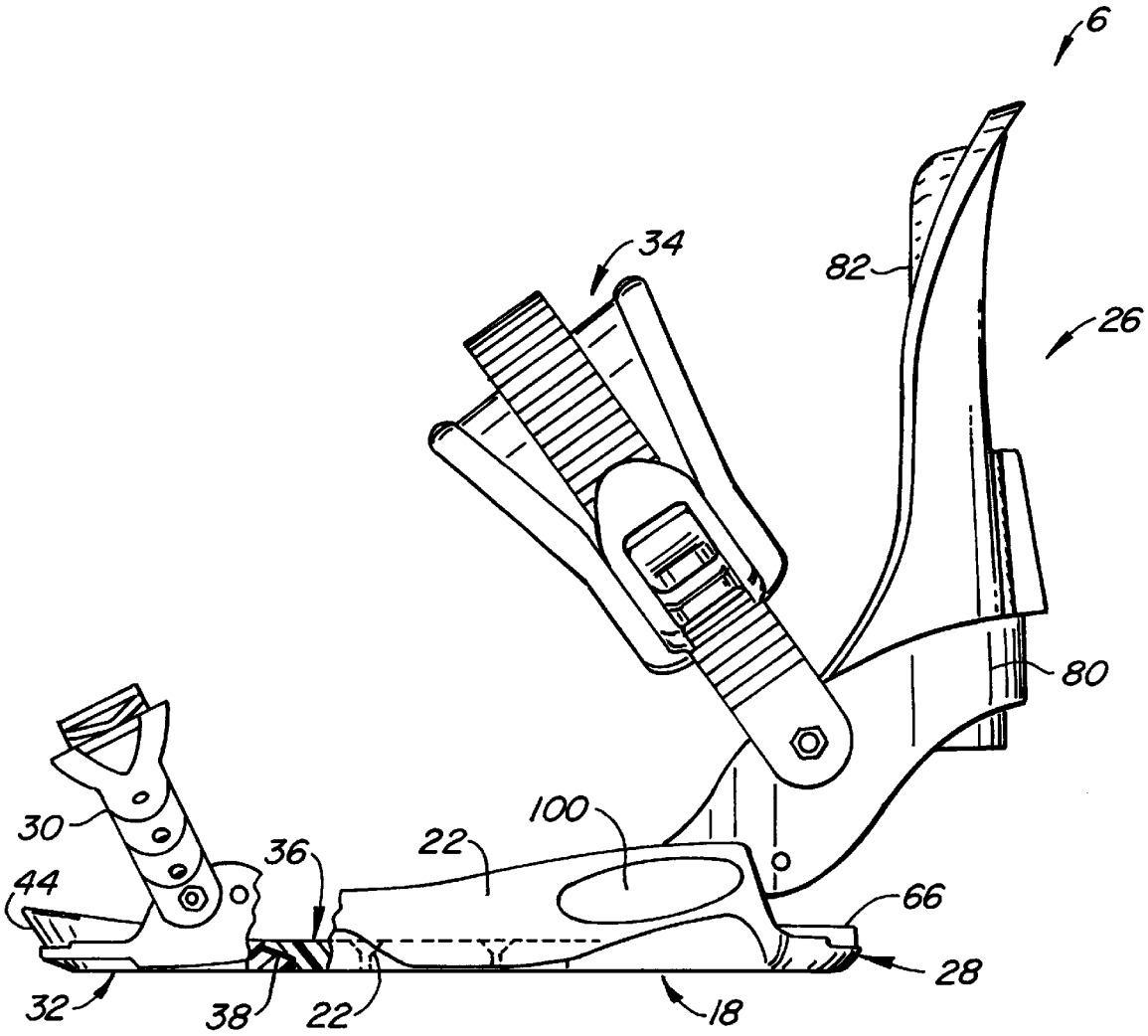
FIG. 2 is a side view of a snowboard binding made according to the invention.
Figure 6:
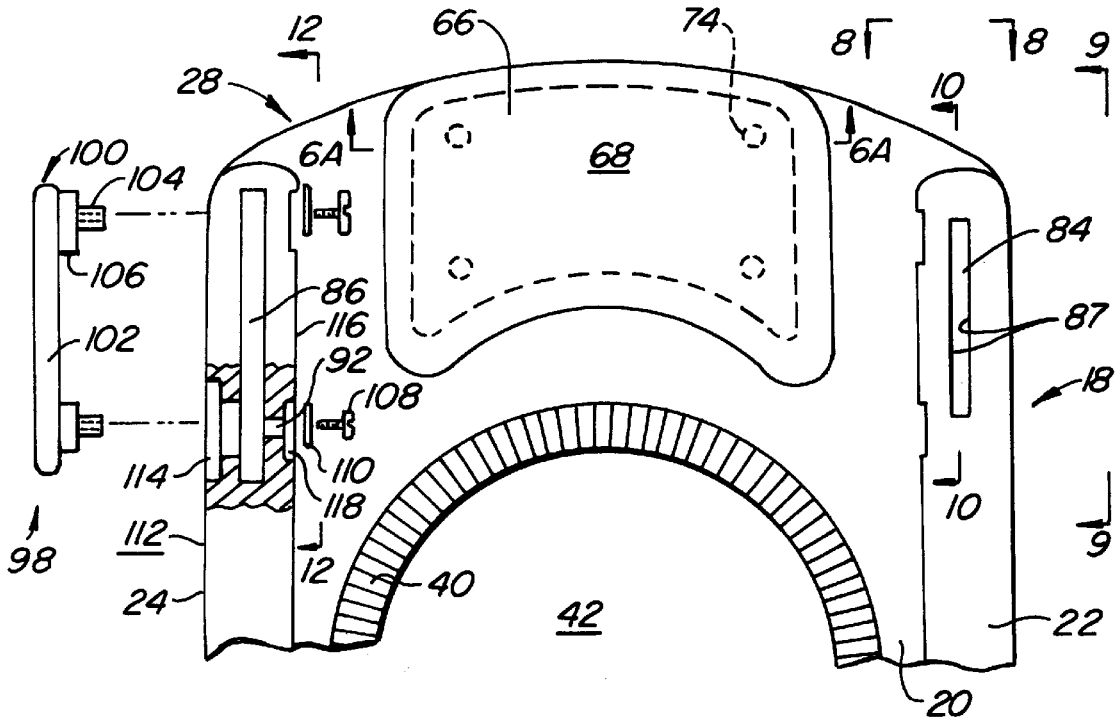
FIG. 6 is a top plan view of the rear end of the base of FIG. 2 showing a coupler assembly in an exploded view.

FIG. 2 illustrates a snowboard binding 6 of FIG. 1 in more detail. Binding 6 includes a base 18 having a base plate 20 and left and right side flanges 22, 24 extending upwardly along the lateral edges of base plate 20. A heel support 26 extends upwardly from the rear end 28 of base 18 while an adjustable toe strap 30 is mounted to and extends upwardly from the front end 32 of base 8. An adjustable instep strap 34 is mounted to base 18 through heel support 26. Binding 6 also includes a circular mounting plate 36 having a serrated, conical, circumferential surface 38 which mates with a similar serrated, conical surface 40 formed in base plate 20 surrounding a central opening 42 formed in base plate 20 as shown in FIG. 6. In the preferred embodiment, the serrations are spaced 3° apart so that the rotary orientation of each snowboard binding 6 on snowboard 4 can be adjusted in 3° increments.

Referring now also to FIGS. 3–5, a toe ramp 44 is shown mounted for front and back movement, that is parallel to arrow 46, and for side-to-side movement, that is parallel to arrow 48. The lower surface 50 of toe ramp 44 is a serrated surface with serrations parallel to arrow 48. Base plate 20 in the region of toe ramp 44 has similarly oriented serrations 52. Serrations 50,52 help ensure the front to back placement of toe ramp 44, once locked into position using screws 54 and nuts 56, does not change. Screws 54 pass through mounting slots 58 in toe ramp 44. Mounting slots 58 are oriented parallel to arrow 48 to permit the lateral or side-to-side positioning of toe ramp 44. Mounting slots 59 are formed in base plate 20; slots 59 are oriented parallel to arrow 46 to permit the front and back positioning of toe ramp 44.

Toe ramp 44 has a contoured upper surface 60 with an upwardly curving front portion 62. Front portion 62 is shaped to conform to, for mating engagement with, the toe or front end 14 of sole 12 of boot 8. The lower surface of front end 14 is rounded so that surface portion 62 of contoured surface 60 follows the same contour as well. Providing this type of conforming, mating engagement between toe ramp 44 and front end 14 of boot sole 12 increases the level of toe-side edge responsiveness while snowboarding because the load is transmitted from the foot through the binding to the board more quickly than with a conventional binding without such a ramp; this results in increased responsiveness and maneuverability for the snowboarder. Other shapes of front end 14 of boot sole will call for other conforming shapes for contoured surface 60.

Figure 6A:
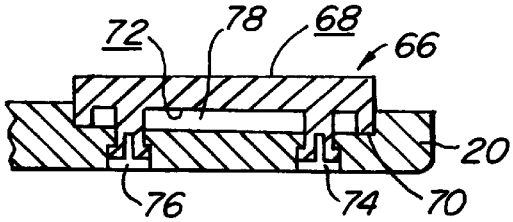
FIG. 6A is a cross-sectional view taken along line 6A—6A of FIG. 6 illustrating the air pocket formed between the heel pad and the base plate.
Figure 7:
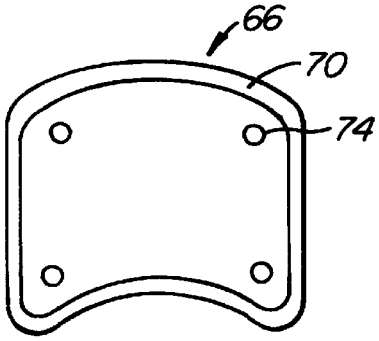
FIG. 7 is a bottom plan view of the heel pad of FIG. 6.
Figure 8:
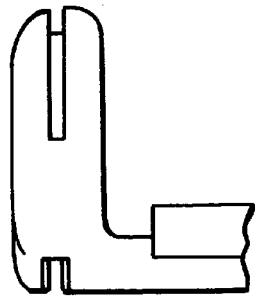
FIG. 8 is an end elevational view of the left side flange taken along line 8—8 of FIG. 6.

FIGS. 6, 6A and 7 illustrate a heel pad 66 mounted to base plate 20 at rear end 28 of base 18. Heel pad 66 includes an upper heel supporting surface 66 and a circumferential rim 70 extending downward from the lower surface 72 of heel pad 66. In this disclosed embodiment, heel pad 66 is secured into place by being placed within a recess formed in base plate 20, see FIG. 6A, and by the use of four mounting pegs 74 passing into four countersunk holes 76 formed in base plate 20. Countersunk holes 76 permit the lower ends of mounting peg 74 to be flared or widened to help ensure retention of heel pad 66 onto base plate 20. Heel pad 66 and base plate 20 define an air pocket 78 in between. Resiliency to impact is provided by both the construction and materials from which heel pad 66 is made, typically urethane, and by the spring effect of air pocket 78. However, air pocket 78 is not sealed so that upon a sufficient impact, the force exerted by heel 16 of sole 12 on heel pad 66 may be such to cause at least part of the air to be expulsed from pocket 78. Due to the inherent resiliency of heel pad 66, heel pad 66 can then return to its original, pre-impact shape, similar to that of FIG. 6A, thus once again filling air pocket 78 with air. Accordingly, heel pad 66 provides a dampened energy absorbing heel pad for the user similar to the spring/shock absorber combination on a car.

Figure 9A:
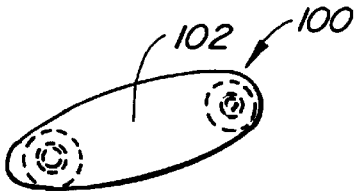
FIG. 9A is a side elevational view of the coupler body of FIG. 6 showing the boss and cylindrical nut in dashed lines.
Figure 9:
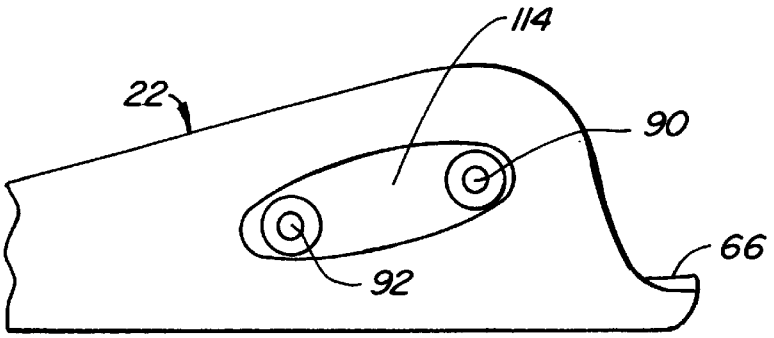
FIG. 9 is a side elevational view of the left side flange of FIG. 6 taken along line 9—9 of FIG. 6.
Figure 10:
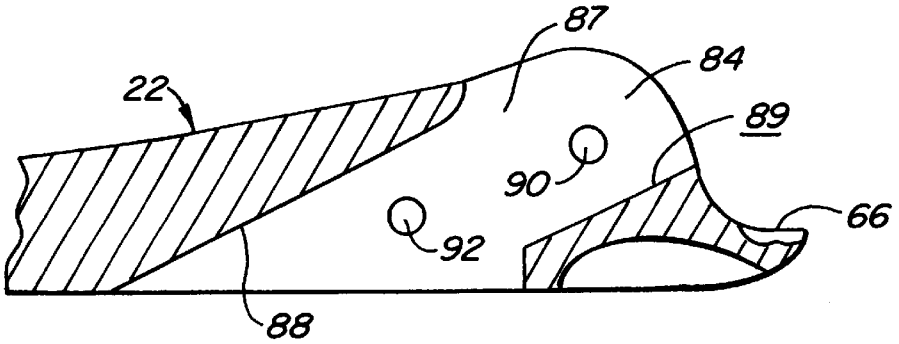
FIG. 10 is a cross-sectional view taken along line 10—10 of FIG. 6 illustrating the arm channel formed in the left side flange.
Figure 11:
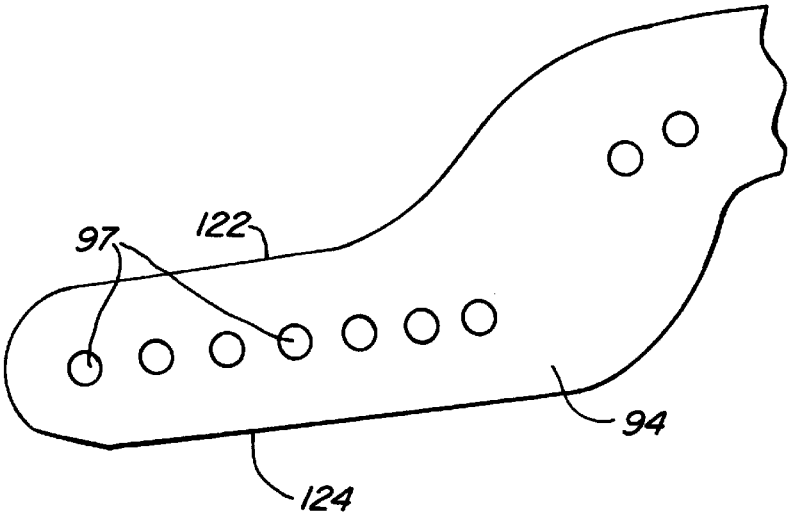
FIG. 11 is a side elevational view of the left mounting arm of the heel loop of FIG. 2 illustrating the sets of spaced-apart mounting bores which align with the mounting holes in the left side flange of FIGS. 9 and 10.

Turning now to FIGS. 2, 6 and 9–12, a further aspect of the invention relating to the mounting of heel support 26 to base 18 will be discussed. Heel support 26 includes a generally U-shaped, rigid heel loop 80 to which a conventional lower leg support 82 is mounted. Each of the left and right side flanges 22,24 have an arm slot 84,86 formed adjacent rear end 28 of base 18. Arm slots 84,86 extend forwardly and downwardly as shown in FIG. 10. Each arm slot 84,86 is bounded by lateral supporting surfaces 87 and upper and lower support surfaces 88,89. Each side flange 22,24 has a pair of vertical longitudinally offset mounting holes 90,92 passing through arm slots 84,86.

Heel loop 80 includes left and right mounting arms 94,96 having sets of pairs of mounting bores 97 spaced apart at appropriate intervals to permit heel loop 80 to be mounted to base 18 at a variety of forward/lower and rearward/upper positions to accommodate boots of different sizes.

Once left and right mounting arms 94,96 are properly positioned within slots 84,86, so that the appropriate mounting bores 97 are aligned with mounting holes 90,92, arms 94,96 are secured within arm slots 84,86 through the use of a pair of coupler assemblies 98. Each coupler assembly 98 comprises a coupler nut 100 having a coupler body 102 from which a pair of internally threaded, cylindrical tubes 104 and cylindrical boses 106 extend. A pair of screws 108 and washers 110 complete each coupler assembly 98.

Figure 12:
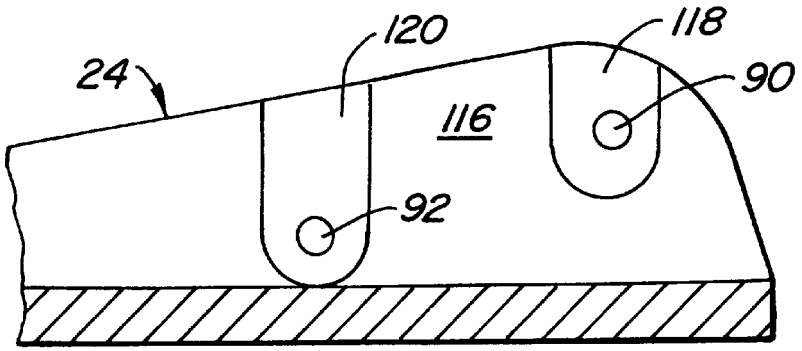
FIG. 12 is a cross-sectional view taken along line 12—12 of FIG. 6 illustrating recesses formed in the inside surface of the right side flange of FIG. 6.

The outside surface 112 of left and right side flanges 22,24 have recesses 114, see FIGS. 6 and 9, sized to accommodate coupler body 102. The portions of holes 90,92 adjacent to recesses 114 are enlarged to accommodate boses 106 while the portions of holes 90,92 adjacent to the inside surface 116 of flanges 22,24, see FIGS. 6 and 12, are sized to accommodate threaded tubes 104. Shallow recesses 118,120 formed in inside surfaces 116 are formed to accommodate washers 110, as screws 108 are secured to threaded tubes 104. Using coupler assembly 98 increases the structural integrity of the connection by evenly distributing the pressure of side surfaces 87 of flanges 22,24 against mounting arms 94,96. Using coupler assembly 98 also speeds up assembly by decreasing the number of parts which must be assembled.

Clamping mounting arms 94,96 within arm slots 84,86 formed within side flanges 22,24 helps to structurally resist the bearing loads in a more efficient manner when loads in a generally vertical plane are exerted by heel loop 80 on base 18. This connection also allows a more symmetrical distribution of bearing stresses between the heel loop 80 and base 18 when side-to-side forces are exerted by heel loop 80 on base 18. Upper and lower edges 122,124 of mounting arms 94,96 are sized so that they are parallel to one another lie adjacent to upper and lower support surfaces 88,89. Thus, the generally vertical plane movements of heel loop 80 are resisted at four different positions, the first two being between side flanges 22,24 and mounting arms 94,96 through internally threaded tubes 104 and screws 108, the third and fourth being through the engagement of upper and lower support surfaces 88,89 with upper and lower edges 122,124.

In use, toe ramp 44 is appropriately positioned using screws 54 and nuts 56 so that toe end 14 of sole 12 properly engages front portion 62 of contoured surface 60. If appropriate, heel pad 66 can be adjusted for position in a manner similar to toe ramp 44. Coupler assemblies 98 are used to properly mount heel support 26 to base 18 according to the size of boots 8. If the rotary orientation of each binding 6 is proper, snowboard assembly 2 is ready to use.

Figure 13:
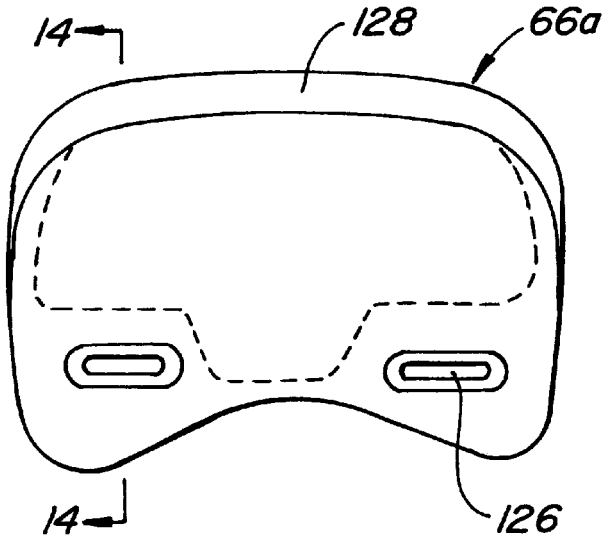
FIG. 13 is a top view illustrating an alternative embodiment of the heel pad of FIG. 6 with lateral positioning slots formed therein.
Figure 14:
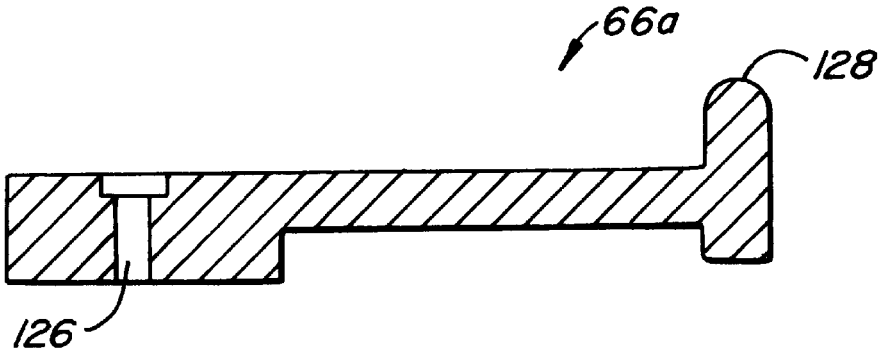
FIG. 14 is a cross-sectional view taken along line 14—14 of FIG. 13.

FIGS. 13 and 14 illustrate a heel pad 66*a* similar to heel pad 66 but constructed to be adjustably mounted to the base. Heel pad 66*a* has a pair of lateral adjustment slots 126, similar to slots 58 of FIG. 4. The base would have longitudinal adjustment slots, not shown but similar to slots 60 of FIG. 3. Using screws and washers, such as those of FIG. 5, permits heel pad 66*a* to be mounted to the base over a range of positions. Heel pad 66*a* also includes an upwardly extending heel rest 128 designed to engage, and preferably conform to, the back edge of heel 16 of sole 12 of boot 8 for additional stability.

The invention can be made from a variety of materials. Preferably, base 18 is made of thermoplastic or thermoset plastic and/or a metal such as aluminum. Toe ramp 44 can be made of a thermoplastic or other suitable materials such as metal or rubber. Heel loop 80 is preferably made of aluminum, although other materials, such as titanium, could also be used. Mounting plate 36 is preferably made of a thermoplastic or a metal, such as aluminum or titanium, while other components, such as toe support 30, instep support 34 and lower leg support 82 can be made of conventional materials.

Modification and variation can be made to the disclosed embodiments without departing from the subject of the invention as defined by the following claims. For example, positional adjustment of toe ramp 44 and heel pad 66 could be accomplished by replacement of an existing toe ramp/heel pad with a different toe ramp/heel pad. Replacement of toe ramp 44 and heel pad 66 could also be used to change the mechanical characteristics, such as hardness, of the toe ramp/heel pad. Toe ramp 44 could be provided with an energy-absorbing pad on its top surface or an energy-absorbing air cavity, similar to air pocket 78, on its underside. Toe ramp 44 preferably closely conforms to the contour of front end 14 of sole 12; however, toe ramp 44 need not do so but rather could be configured to contact front end 14 at appropriate locations and/or regions to effectively transmit force from the front end of the sole to the toe ramp.

What is claimed is:

1. In a snowboard binding of the type comprising a base having front and rear ends, and boot binding structure releasably coupling a snowboard boot to the base, the improvement comprising:

a toe ramp mounted to the front end of the base;

the toe ramp having an upwardly-extending, sole-supporting upper surface shaped for supporting engagement with a front end of a sole of a snowboard boot for improved performance;

adjustable means for securing the toe ramp to the base over a range of front-to-rear positions; and the toe ramp comprising a rigid front portion which extends forward of the front end of the base in a cantilevered manner;

whereby the toe ramp enhances responsiveness by transmitting force from the foot through the binding to the snowboard.

2. The improved snowboard binding according to claim 1 wherein said upper surface of the toe ramp is an upwardly curving, concave surface.

3. The improved snowboard binding according to claim 1 wherein the upper surface of the toe ramp is generally sole-conforming.

4. The improved snowboard binding according to claim 1 further comprising means for adjustably securing the toe ramp to the base over a range of side-to-side positions.

5. The improved snowboard binding according to claim 1 wherein said toe ramp comprises an energy-absorber.

6. In a snowboard binding of the type comprising a base having front and rear ends and boot binding structure releasably coupling a snowboard boot to the base, the improvement comprising:

a toe ramp mounted to the front end of the base;

the toe ramp having an upwardly-extending, sole-supporting upper surface shaped for supporting engagement with a front end of a sole of a snowboard boot for improved performance; and adjustable means for securing the toe ramp to the base over a range of front-to-rear positions.

7. The improved snowboard binding according to claim 6 wherein said upper surface of the toe ramp is an upwardly curving, concave surface.

8. The improved snowboard binding according to claim 6 wherein the upper surface of the toe ramp is generally sole-conforming.

9. In a snowboard binding of the type comprising a base having front and rear ends and boot binding structure releasably coupling a snowboard boot to the base, the improvement comprising:

a toe ramp mounted to the front end of the base;

the toe ramp having an upwardly-extending, sole-supporting upper surface shaped for supporting engagement with a front end of a sole of a snowboard boot for improved performance; and the toe ramp further having a front end which extends obliquely relative to left and right sides thereof edge half located rearwardly.

10. In a snowboard binding of the type comprising a base having front and rear ends and boot binding structure releasably coupling a snowboard boot to the base, the improvement comprising:

a heel pad mounted to the rear end of the base;

adjustable means for securing the heel pad to the base over a range of front-to-rear positions; and a dampened energy-absorber associated with the heel pad, whereby impact loads exerted by a heel of a snowboard boot can be at least partially absorbed by said dampened energy absorber.

11. The improved snowboard binding according to claim 10 further comprising adjustable means for securing the heel pad to the base over a range of side-to-side positions.

12. The improved snowboard binding according to claim 10 wherein the heel pad comprises an upwardly-extending heel rest portion.

13. In a snowboard binding of the type comprising a base having front and rear ends and boot binding structure releasably coupling a snowboard boot to the base, the boot binding structure comprising a heel support extending from the rear end of the base, the improvement comprising:

said heel support comprising left and right mounting arms, each mounting arm comprising right and left lateral surfaces and upper and lower edges;

said base comprising a base plate and left and right side flanges extending upwardly from the base plate;

said right and left side flanges each having an arm channel formed therein, said arm channels housing said right and left mounting arms;

said arm channels formed in said side flanges being defined in part by right and left lateral support surfaces adjacent to the right and left lateral surfaces of the mounting arms;

said right and left flanges binding said respective mounting arms at the entire lateral support surfaces thereof; and a mounting element biasing the lateral support surfaces against the lateral surfaces of each mounting arm to secure the mounting arms within the arm channels of the side flanges.

14. The improved snowboard binding according to claim 13 wherein the mounting element comprises a threaded fastener; and each said mounting arm comprises a mounting bore formed therein, each said side flange comprises a mounting hole formed therein, and the threaded fastener includes a first portion passing through an aligned mounting hole and mounting bore.

15. The improved snowboard binding according to claim 13 wherein said arm channels are defined in part by upper and lower support surfaces adjacent to the upper and lower edges of the mounting arms so that said channels circumscribe the mounting arms, the upper and lower support surfaces being generally parallel surfaces extending downwardly towards the base and forwardly towards the front end of the base.

16. The improved snowboard binding according to claim 13 wherein:

each said mounting arm comprises first and second spaced-apart mounting bores with one said mounting element passing through each said mounting bore; and said side flanges each have first and second mounting holes, said mounting bores being alignable with the mounting holes so a rearward force on the heel support is resisted at each side flange; and said mounting element comprises a coupler assembly including first and second projections for aligning said first and second mounting holes with said first and second mounting bores and a coupler body rigidly interconnecting said projections in a spaced-apart relationship.

17. The improved snowboard binding according to claim 15 wherein:

each said mounting arm comprises first and second spaced-apart mounting bores with one said mounting element passing through each said mounting bore; and said side flanges each have first and second mounting holes, said mounting bores being alignable with the mounting holes so a rearward force on the heel support is resisted at each side flange by:

the inter-engagement of the side flange, the mounting arm and mounting elements; and the inter-engagement of the upper and lower support surfaces with the upper and lower edges of the mounting arm.

18. In a snowboard binding of the type comprising a base having front and rear ends and boot binding structure releasably coupling a snowboard boot to the base, the improvement comprising:

a toe ramp mounted to the front end of the base;

the toe ramp having a contoured upper surface with an upwardly-extending front portion shaped for engagement with a front end of a sole of a snowboard boot for improved performance; and means for adjustably securing the toe ramp to the base over a range of side-to-side positions.

19. In a snowboard binding of the type comprising a base having front and rear ends and boot binding structure releasably coupling a snowboard boot to the base, the improvement comprising:

a heel pad mounted to the rear end of the base; and a dampened energy-absorber associated with the heel pad, the dampened energy-absorber comprising an air pocket formed between the heel pad and the base;

whereby impact loads exerted by a heel of a snowboard boot can be at least partially absorbed by said dampened energy absorber.

20. In a snowboard binding of the type comprising a base having front and rear ends and boot binding structure releasably coupling a snowboard boot to the base, the boot binding structure comprising a heel support extending from the rear end of the base, the improvement comprising:

a toe ramp mounted to the front end of the base;

the toe ramp having a contoured upper surface with an upwardly extending front portion shaped for engagement with a front end of a sole of a snowboard boot for improved performance;

the toe ramp further having a front end which extends obliquely relative to left and right sides thereof;

a heel pad mounted to the rear end of the base;

a dampened energy absorber associated with the heel pad, whereby impact loads exerted by a heel of a snowboard boot can be at least partially absorbed by said dampened energy absorber;

said dampened energy absorber comprises an air pocket formed between the heel pad and the base;

said heel support comprising left and right mounting arms, each mounting arm comprising right and left lateral surfaces and upper and lower edges;

said base comprising a base plate and left and right side flanges extending upwardly from the base plate;

said right and left side flanges each having an arm channel formed therein, said arm channels housing said right and left mounting arms;

said arm channels formed in said side flanges being defined in part by right and left lateral support surfaces adjacent to the right and left lateral surfaces of the mounting arms; and a mounting element biasing the lateral support surfaces against the lateral surfaces of each mounting arm to secure the mounting arms within the arm channels of the side flanges.

* * * * *